United States Patent [19]

Reinfried, Jr. et al.

[11] Patent Number: 4,971,208

[45] Date of Patent: Nov. 20, 1990

[54] FIREARM SUPPORT

[76] Inventors: Henry F. Reinfried, Jr., 4816 S. Geronimo Rd.; Samuel W. Bradford, 902 Lazy La., both of Prescott, Ariz. 86303

[21] Appl. No.: 432,928

[22] Filed: Nov. 6, 1989

[51] Int. Cl.[5] ..... F41C 29/00

[52] U.S. Cl. ..... 211/64; 42/94

[58] Field of Search ..... 211/64; 42/94; 89/37.04

[56] References Cited

U.S. PATENT DOCUMENTS

| | | | |
|---|---|---|---|
| 2,458,608 | 1/1949 | Lea | 42/94 X |
| 2,740,530 | 4/1956 | Ponder | 211/64 |
| 3,235,997 | 2/1966 | Stoner | 42/94 |
| 3,235,998 | 2/1966 | Hadley | 42/94 |
| 3,329,278 | 7/1967 | Pachmayr | 211/64 |
| 3,361,265 | 1/1968 | Wernimont | 211/64 |
| 3,473,673 | 10/1969 | Porter | 211/64 |
| 4,397,112 | 8/1983 | York | 42/94 |
| 4,449,314 | 5/1984 | Sorensen | 211/64 X |
| 4,807,381 | 2/1989 | Southard | 211/64 X |
| 4,819,359 | 4/1989 | Bassett | 42/94 |

*Primary Examiner*—Blair M. Johnson
*Attorney, Agent, or Firm*—Edward W. Hughes

[57] ABSTRACT

An adjustable stand for holding a firearm includes a front clamp for holding the barrel of a firearm, a first rear clamp for holding the stock of the firearm if the firearm is a rifle or shotgun, and a second rear clamp, located between the front clamp and the first rear clamp, for holding the grip of the firearm if the firearm is a pistol. The front clamp and the first rear clamp each include a pair of jaws pivotally joined to one another. A number of pairs of aligned notches are formed in the inner surfaces of the jaws for accommodating firearms of different sizes and types. The second rear clamp includes a base member having a substantially flat bottom surface for supporting the stand, and a top surface provided with an indentation for receiving the grip of a pistol. A retaining arm is movably secured to the base member for clamping the grip into the indentation. The front clamp and first and second rear clamps are mounted for translation along a threaded rod which also defines the axis about which the jaws of the front clamp and first rear clamp pivot.

17 Claims, 2 Drawing Sheets

74
30
50
40
56
58
54
60
32
76
62
63
70
64
58
42
52
54
28
78
57

28
62
102
63
70
64
48
46
40
58
54
60
44

62
14
72
63
20
70
64
24

72
24
62
63
65
66
26
70
64
20

72
24
62
63
67
68
70
26
64
20

72
30
18
28
22

84
34
86
102
100
88
89
80
94
98
92
90
96

FIREARM SUPPORT

BACKGROUND OF THE INVENTION

1. Field of the Invention

This invention relates to the art of firearm supports.

More particularly, the present invention relates to a stand for gripping the front and rear ends of a firearm such as a shotgun, rifle, or pistol.

In a further and more specific aspect, the present invention concerns an adjustable stand comprising a front clamp for holding the barrel of a gun and a pair of rear clamps, one of which is used to hold the stock if the gun is a rifle or shotgun, and the other of which is used to hold the grip if the gun is a pistol.

2. Prior Art

Various types of stands and racks or trays are available for supporting firearms while they are being assembled or disassembled, cleaned, repaired, displayed, or the like. Examples of such devices are disclosed in U.S. Pat. No. 2,740,530 to Ponder, U.S. Pat. No. 3,329,278 to Pachmayr, U.S. Pat. No. 3,361,265 to Wernimont, and U.S. Pat. No. 3,964,613 to Anderson, Jr.

Each of the above devices is tailored for use with a specific type of gun. The device disclosed by Anderson, Jr., for instance, comprises a pair of fixed end members, one of which is provided with a relatively shallow notch for receiving the barrel of a rifle and the other of which is provided with a deeper notch for receiving the stock of the rifle. Because the depth and width of each notch and the distance between the end members is fixed, only rifles of a particular length, barrel diameter and stock size can be accommodated.

The device disclosed by Wernimont comprises a single saddle member for supporting the fore-end of a gun stock. The saddle member is made up of two arms, the distance between which can be adjusted to accommodate stocks of differing widths. While the adjustable saddle makes the device of Wernimont somewhat more versatile than that of Anderson, Jr., it is still limited to use with guns having relatively elongated stocks, and is not suitable for supporting shorter firearms such as pistols.

The devices disclosed by Ponder and Pachmayr, on the other hand, are trays for supporting pistols. Each of these trays includes a flat base member having an upstanding clamping member or bracket formed at one end. The barrel of the pistol is supported by the clamping member, while the bottom of the pistol's grip rests directly on the flat base member. Neither tray is suitable for supporting an elongated firearm such as a rifle or shotgun.

The single-purpose design of each of the above supports creates a problem for the serious gun collector or hunter who may own a variety of firearms of different sizes and configurations. Such an individual would have to purchase at least two types of supports—one for rifles and shotguns, and one for pistols. This can be rather expensive and inefficient.

Another shortcoming of some of the above gun stands and other types of supports available in the marketplace is their relative lack of security. Many gun stands are designed for display purposes only, and thus do not grip the guns as tightly as desired when the gun is being cleaned o repaired. A tight grip is essential to prevent the gun from shaking or dropping while being worked on.

Still another shortcoming of prior art devices is their complexity. Many such devices are manufactured from a large number of moving parts, making them costly and difficult to assemble and use. In addition, the devices are often heavy and unwieldy, making them difficult to carry to the field or shooting range.

It would be highly advantageous, therefore, to remedy the foregoing and other deficiencies of the prior art.

Accordingly, it is an object of the present invention to provide an improved stand for holding a firearm.

Another object of the invention is the provision of a firearm holder with means for gripping either the stock of an elongated firearm, such as a rifle or shotgun, or the grip of a shorter firearm, such as a pistol.

Still another objeCt of the invention is to provide a firearm holder with a front end clamp having a plurality of notches for accommodating guns having various different barrel configurations.

And another object of the invention is the provision of a firearm holder which securely grips both ends of a gun in a right-side-up position to allow cleaning, repair, bore sighting, scope mounting, and the like with minimal vibration or slippage.

Yet another object of the InventIon Is to provide a firearm support which will not damage or scratch the surface of the gun.

Yet still another object of the present invention is the provision of a relatively lightweight firearm support which is easy to transport and store.

And still another object of the invention is to provide a firearm support, according to the foregoing, which is relatively inexpensive to manufaCture and comparatively simple and easy to use.

SUMMARY OF THE INVENTION

Briefly, to achieve the desired objects of the instant invention in accordance with a preferred embodiment thereof, there is provided a firearm support including a front clamp for holding the barrel of a firearm, a first rear clamp for holding the stock of the firearm if the firearm is a rifle or shotgun, and a second rear clamp, located between the front clamp and the first rear clamp, for holding the grip of the firearm if the firearm is a pistol.

The front clamp includes a pair of generally triangular jaws pivotally joined to one another. Fastening means, such as a strips of material provided with cooperating hooks and loops, are provided for securing the jaws in a clamped configuration about the barrel of the firearm. A number of pairs of aligned notches are formed in the inner surfaces of the jaws for receiving barrels of different sizes and types.

The first rear clamp includes a pair of jaws which are substantially identical in structure to the jaws of the front clamp. In addition, a bar pivotally secured to one of the jaws functions as a stop which contacts the butt of the firearm to prevent the firearm from sliding rearwardly out of the stand.

The second rear clamp includes a base member having a substantially flat bottom surface for supporting the stand, and a top surface provided with a cavity for receiving the grip of a pistol. A retaining arm is movably secured to the base member for clamping the grip into the cavity. Fastening means similar to those found on the front clamp and second rear clamp are provided for securing the retaining arm in a clamped position.

The front clamp and first and second rear clamps are attached to one another by means of a threaded rod which also serves as the hinge axis about which the jaws of the front clamp and first rear clamp rotate. All three of the clamps are mounted for translation along the rod. This allows adjustment of the distances between each of the clamps so that firearms of different barrel lengths can be accommodated.

BRIEF DESCRIPTION OF THE DRAWINGS

The foregoing and other objects, features and advantages of the instant invention will become readily apparent to those skilled in the art from the following detailed description of the preferred embodiments thereof, taken in conjunction wIth the drawings in which.

DETAILED DESCRIPTION OF THE PREFERRED EMBODIMENTS

Figure 1:
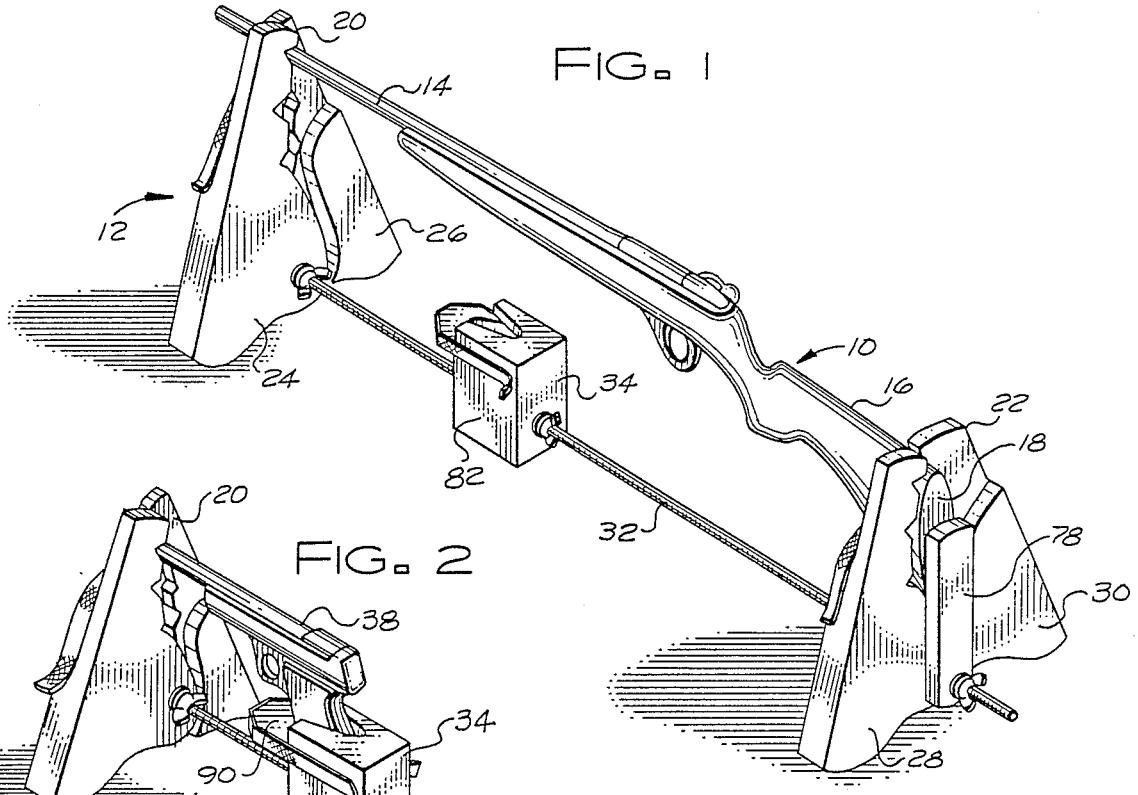
FIG. 1 is a perspective view showing a rifle mounted in the firearm support of the present invention.

Turning now to the drawings, in which like reference characters indicate corresponding elements throughout the several views, attention is first directed to FIG. 1 which shows a rifle 10 mounted in the firearm support 12 of the present invention. The rifle 10, as is generally well known, comprises an elongated barrel 14 which extends forwardly from a rear portion known as the stock 16. The rearmost face of the stock 16 comprises the butt 18 of the rifle 10.

The firearm support 12 comprises a front clamp 20 for gripping the barrel 14 of the rifle 10 and a first rear clamp 22 for gripping the stock 16 of the rifle 10 or other elongated type of firearm, such as a shotgun. The front clamp 20, which comprises a first front jaw 24 and a second front jaw 26, is connected to the rear clamp 22, which comprises a first rear jaw 28 and a second rear jaw 30, by a threaded hinge pin, or pivot rod 32. Rod 32 also defines the axis of rotation about which the first and second front and rear jaws 24, 26, 28 and 30 pivot.

Figure 2:
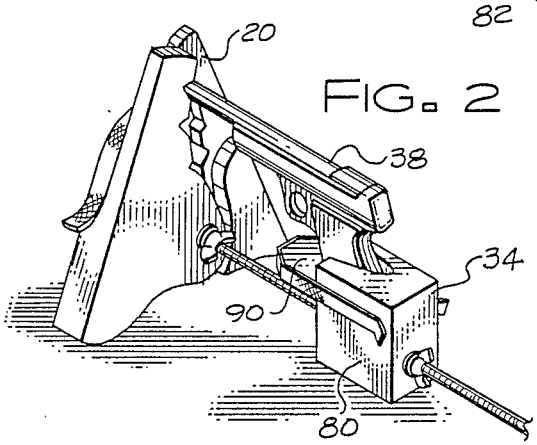
FIG. 2 is a fragmentary perspective view showing a pistol mounted in the firearm support of the present invention.
Figure 3:
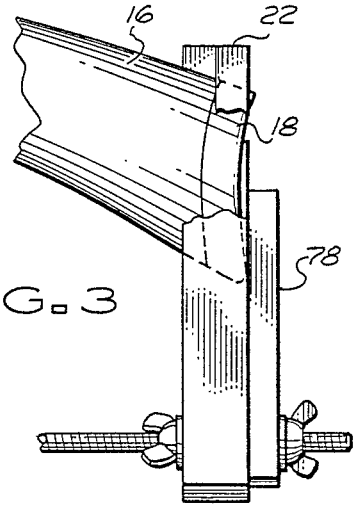
FIG. 3 is a fragmentary side view of the rear clamp of the firearm support of FIG. 1, with a portion broken away to reveal the butt of the rifle.
Figure 4:
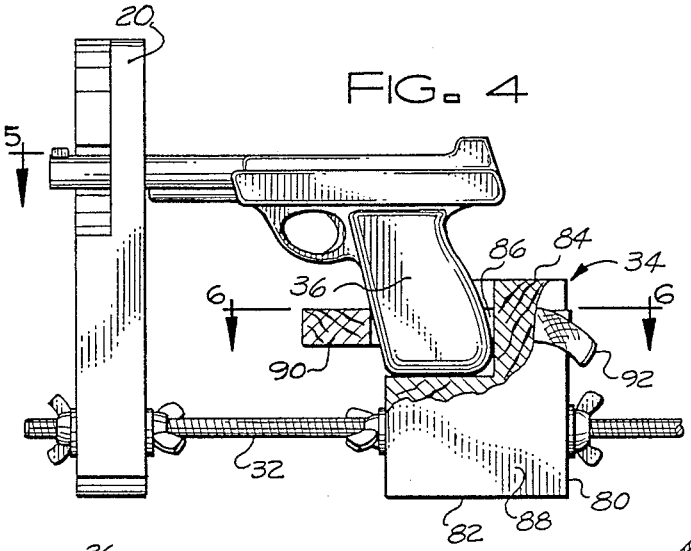
FIG. 4 is an enlarged side view of FIG. 2, with a portion of the pistol clamp broken away to show the pistol grip.
Figure 5:
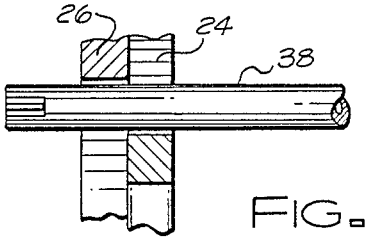
FIG. 5 is a sectional view taken through line 5—5 of FIG. 4.
Figure 6:
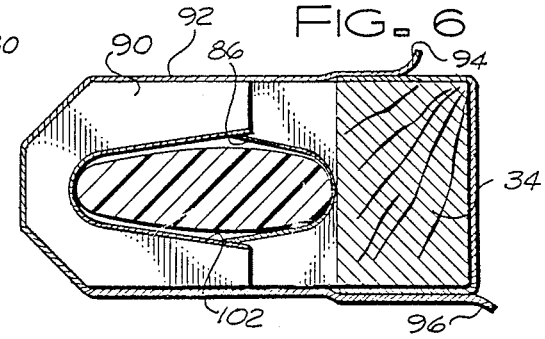
FIG. 6 is a sectional view taken through line 6—6 of FIG. 4.

A second rear clamp 34 is mounted on the rod 32 intermediate the front clamp 20 and the first rear clamp 22. The second rear clamp 34 holds the grip 36 of a pistol 38, as shown in FIGS. 2 and 4, if the user wishes to support a pistol rather than an elongated firearm of the type shown in FIG. 1.

Figures 7, 8, 9, 10, 11, 12, 13:
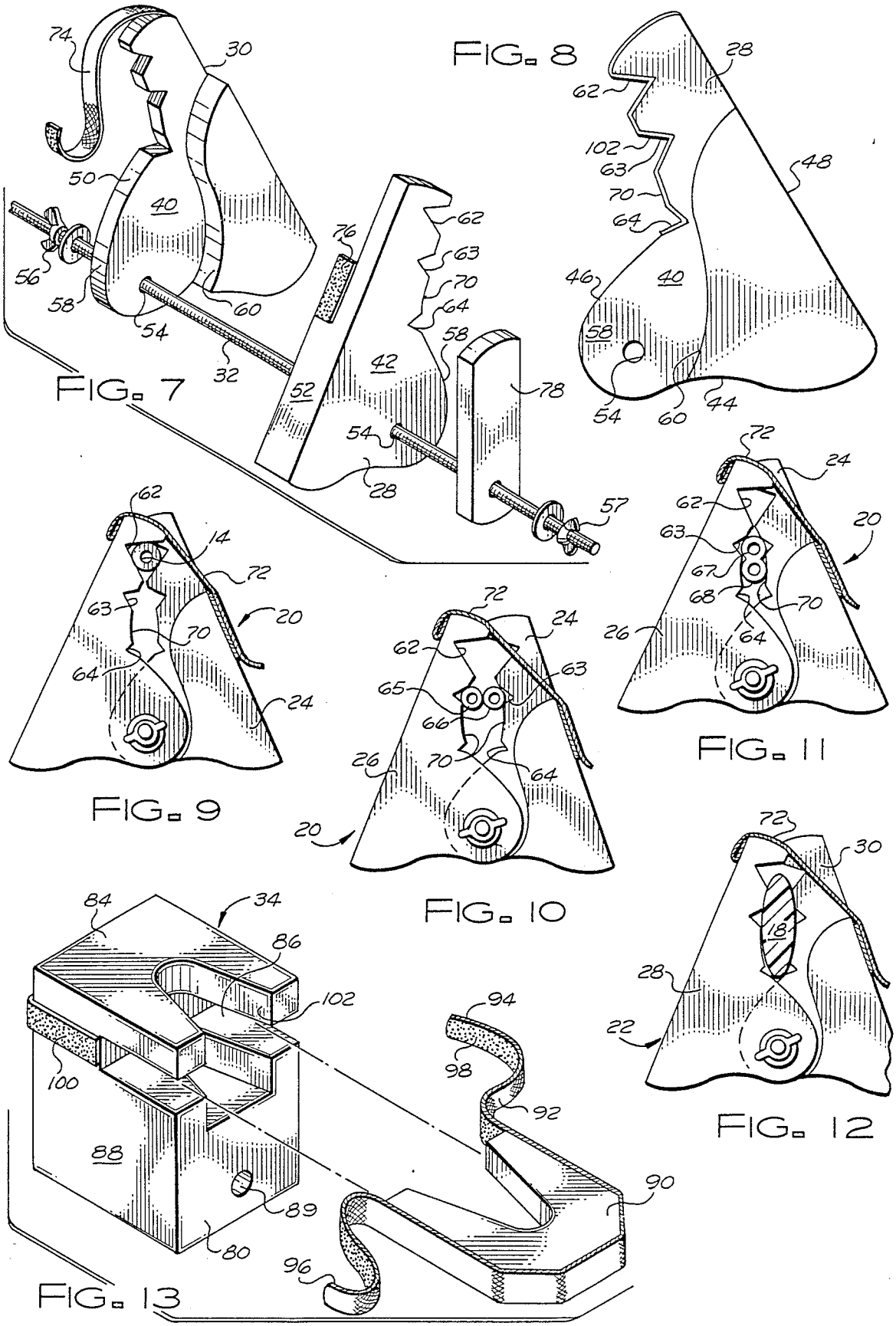
FIG. 7 is an exploded fragmentary view showing the rear clamp of the firearm support of FIG. 1.
FIG. 8 is a front view of a jaw of a front or rear clamp of the firearm support.
FIG. 9 is a front view of the firearm support having a rifle mounted therein.
FIG. 10 is a front view, similar to FIG. 9, showing a side-by-side double-barreled shot gun mounted in the firearm support.
FIG. 11 is a front view, similar to FIGS. 9 and 10, showing an over-under double-barreled shotgun mounted in the firearm support.
FIG. 12 is a rear view, partially sectioned, of the firearm support of FIG. 1.
FIG. 13 is an exploded perspective view showing the pistol clamp of the firearm support.

For ease of manufacture, each of the jaws 24, 26, 28 and 30 of the front clamp 20 and first rear clamp 22, is identical to the others. One of the jaws, identified for sake of convenience as first rear jaw 28, is illustrated in FIG. 8. The jaw 28 comprises a front surfaCe 40 and a rear surface 42 (seen in FIG. 7). Both front surface 40 and rear surface 42 are roughly triangular in configuration, each having a bottom edge 44 which acts as a base for supporting the jaw 28 in an upright position, and a pair of side edges 46, 48, which converge at the top of the jaw 28. In addition, the jaw 28 includes an inner surface 50 which extends between the inner side edge 46 of the front surface 40 and the inner side edge of the rear surface 42, and an outer surface 52 which extends between the outer side edge 48 of the front surface 40 and the outer side edge of the rear surface 42. A bore 54 is formed through the front and rear surfaces 40, 42 of the jaw 28, proximate the intersection of bottom edge 44 and inner side edge 46.

The manner in which the first rear jaw 28 is secured to the second rear jaw 30 is shown in FIG. 7. The first rear jaw 28 is placed in front-to-front relationship with the second rear jaw 30 so that the bore 54 of the first rear jaw 28 is aligned with the identical bore 54 in the second rear jaw 30. Rod 32 extends through the aligned bores 54. The first and second rear jaws 28 and 30 are secured at a selected location along hinge rod 32 by means of two wing nuts 56 and 5? between which the jaws 28 and 30 are sandwiched. The wing nuts 56 and 57 can easily be loosened by hand, allowing the jaws 28 and 30 to be slid along rod 52, so that the distance between front clamp 20 and rear clamp 30 can be adjusted to accommodate firearms of different lengths. First front jaw 24 and second front jaw 26 are secured to one another in the same manner.

The lower end of the inner surface 50 of the jaw 28 is formed as a curved portion 58 which cooperates with a curved stop wall 60 formed on the front surface 40 of mating jaw 30 to prevent the jaws 28, 30 from pivoting too far inwardly when the jaws 28, 30 are secured together in front-to front relationship as shown in FIG. 7.

The upper end of the inner surface 50 of the jaw 28 comprises a plurality of spaced apart notches 62, 63, 64 which are substantially aligned with similar notches on mating jaw 30. These notches have no special function in the rear jaws 28 and 30. However, their purpose in the front jaws 24 and 26 is to receive the barrel of the firearm. The differing locations of the notches 62, 63, 64 allow a wide variety of guns having different barrel configurations to be accommodated. For instance, a conventional rifle 10 of the type shown in FIG. 1, may have its barrel received in the uppermost notch 62, as shown in FIG. 9. A side-by-side double barreled shotgun would have its barrels 65, 66 received in center notch 63, with the two jaws 24 and 26 pivoted farther apart to increase the effective width of the notches, as shown in FIG. 10. An over-under double-barreled shotgun could have one of its barrels 67 received in center notch 63, while the other barrel 68 would be received in the space between the center notch 63 and either the uppermost notch 62 or the lowermost notch 64, as shown in FIG. 11. The barrel of a pistol 38 could be received in any one of the three notches, depending on the height of the pistol.

A substantially straight portion 70 is formed in the inner surface 50 of each jaw between the center notch 63 and the lowermost notch 64. The straight portions 70 of two mating jaws form a pair of parallel side walls which can accommodate the housing of the firearm if the firearm is a semi-automatic pistol, such as a 45 caliber "COLT" (not shown), which has a parallel-sided housing.

Fasteners 72 are provided on front and rear clamps 20 and 22 for securing the first and second jaws of each clamp into a clamped configuration about the barrel of the firearm. In the illustrated embodiment, the fasteners are in the form of straps 74 secured to the outer surface of the second front jaw 26 and the second rear jaw 30. The underside of each strap 74 is provided with a plurality of hook and loop fasteners such as the type identified by the trademark "VELCRO", which cooperate with mating fasteners provided on a pad 76 secured to the outer surface of the first front jaw 24 and the first rear jaw 28.

A stop member is secured to rear clamp 22 for preventing the butt 18 of a rifle or shotgun mounted on the support 12 from sliding rearwardly out of the clamp 22. In the illustrated embodiment, the stop member is in the form of a substantially rectangular bar 78 which is pivotally secured to the rod 32. Stop members of other configurations may also be used.

The second rear clamp 34, also known as the pIstol clamp, is shown in FIGS. 2, 4-6 and 13. The pistol clamp 34 comprises a block-shaped base member 80 having a substantially flat bottom surface 82 which is flush wIth the ground or other surface on which the firearm support 12 is placed. Opposite the bottom surface 82 is a top surface 84. A generally U-shaped cavity 86 is formed in the top surface 84 for receiving the grip 36 of the pistol 38. A sidewall 88 extends between the top surface 84 and the bottom surface 82. A bore 89 through the base member 80 slidably receives rod 32, allowing the distance between the pistol clamp 34 and the front clamp 20 to be varied, depending on the length of the pistol 38 to be supported.

The pistol grip 36 is clamped in the cavity 86 by a generally U-shaped retaining member 90 which opens in the direction opposite to the U-shaped cavity 86. The retaining member 90 is releasably secured to the sidewall 88 of the base member 80 by a fastener comprising an elongated strap 92, the central portion of which is secured to retaining member 90, and the opposite ends 94, 96 of which are provided with hook and loop fasteners 98 which cooperate with mating fasteners 100 provide on the base member 80.

All of the major parts of the firearm support, except for rod 32 and the wing nuts 57, are preferably made of lightweight material such as wood or plastic, allowing the support 12 to be easily manufactured and transported. In addition, all the inner surfaces of the clamps 20, 22 and 34 which come into direct contact with the firearm are preferably coated with a protective material 102 such as "PLASTISOL", which prevents the surface of the gun from becoming scratched.

Various changes and modifications to the embodiments herein chosen for purposes of illustration will readily occur to those skilled in the art. In addition, it is clear that the present invention need not be limited to use with firearms, but that it may also be used to support other types of sporting equipment such as archery bows and fishing poles. To the extent that such modifications and variations do not depart from the spirit of the invention, they are intended to be included within the scope thereof, which is limited only by a fair interpretation of the appended claims.

Having fully described and disclosed the instant invention in such clear and concise terms as to enable those skilled in the art to understand and practice the same, the claimed invention is set forth below.

What is claimed is:

1. A stand for supporting a firearm, said stand comprising:

(a) front clamping means for holding the front end of said firearm, said front clamping means including a first front jaw and a second front jaw;

(b) first rear clamping means spaced rearwardly of said front clamping means for holding the rear end of said firearm if said firearm is elongated, said first rear clamping means including a first rear jaw and a second rear jaw;

(c) a rod extending between said front clamping means and said rear clamping means for pivotally securing said first front jaw to said second front jaw and said first rear jaw to said second rear jaw; and (d) second rear clamping means mounted on said hinge rod intermediate said front clamping means and said first rear clamping means for holding the rear end of said firearm if said firearm is a pistol.

2. The stand according to claim 1, wherein said front clamping means comprises:

(a) a first pair of aligned notches formed in said first front jaw and said second front jaw for receiving the barrel of said firearm if said firearm is a rifle;

(b) a second pair of aligned notches formed in said first front jaw and said second front jaw beneath said first pair of aligned notches for receiving the barrels of said firearm if said firearm is a side-by-side double-barreled shotgun; and (c) a third pair of aligned notches formed in said first front jaw and said second front jaw beneath said second pair of aligned notches.

3. The stand according to claim 2, wherein said front clamping means further includes a pair of parallel, spaced apart walls formed in said first front jaw and said second front jaw intermediate said second pair of aligned notches and said third pair of aligned notches for receiving the housing of said firearm if said firearm is a semi-automatic pistol having a housing with parallel sides.

4. The stand of claim 1, further comprising fastening means attached to said front clamping means, said first rear clamping means, and said second rear clamping means for securing each of said clamping means in a clamped configuration when said firearm is mounted on said stand.

5. The stand of claim 1, wherein said second rear clamping means is mounted for movement along said rod to allow adjustment of the distance between said second rear clamping means and said front clamping means to accommodate pistols of varying lengths.

6. The stand of claim 1, wherein at least one of said front clamping means and said first rear clamping means is mounted for movement along said rod to allow adjustment of the distance between said first rear clamping means and said front clamping means to accommodate rifles and shotguns of varying lengths.

7. The stand of claim 1, wherein said second rear clamping means comprises:

(a) a base member including (i) a flat bottom surface for supporting said stand,
(ii) a top surface opposite said bottom surface, said top surface having an cavity formed therein for receiving the grip of a pistol, and
(iii) a sidewall extending between said bottom surface and said top surface; and
(b) retaining means movably secured to said sidewall for clamping the grip of said pistol into said cavity.

8. A stand for supporting a firearm including an elongated barrel projecting from a stock, said stock having a butt formed at the rear end thereof, said stand comprising:
(a) barrel clamping means for holding the barrel of said firearm, said barrel clamping means including a first front jaw and a second front jaw;
(b) stock clamping means spaced rearwardly of said barrel clamping means for holding the stock of said firearm, said stock clamping means including a firs rear jaw and a second rear jaw;
(c) a rod, the first front jaw and the second front jaw of the barrel clamping means, and the first rear jaw and the second rear jaw of the stock clamping means being pivotally mounted on said rod;
(d) means for securing the barrel clamping means and the stock clamping means on said rod to cart the distance between the barrel clamping means and the stock clamping means to accommodate firearms of varying lengths; and
(e) stop means mounted on said rod for preventing the stock of a firearm from moving away from the barrel clamping means.

9. The stand of claim 8, wherein each of said first and second front and rear jaws comprises:
(a) a generally triangular front surface;
(b) a generally triangular rear surface opposite said front surface;
(c) a bottom surface for supporting said jaw members in an upright position;
(d) an inner surface extending between said front and rear surfaces for contacting said firearm when said jaws are in a closed position; and
(e) an outer surface opposed to said inner surface.

10. The stand of claim 9, wherein the inner surface of each of said jaws is coated with a protective material for preventing scratching of said firearm.

11. The stand of claim 9, wherein the inner surface of said first and second front jaws comprises a plurality of notches for accommodating barrels of different sizes and types.

12. The stand of claim 11, wherein said plurality of notches includes:
(a) a first pair of aligned notches formed in said first front jaw and said second front jaw for receiving the barrel of said firearm if said firearm is a rifle: and
(b) a second pair of aligned notched formed in said first front jaw and said second front jaw beneath said first pair of aligned notches for receiving the barrels of said firearm if said firearm is a side-by-side double-barreled shotgun.

13. The stand of claim 8, wherein said stop means comprises a bar pivotally mounted on said rod.

14. The stand of claim 8, further comprising fastening means attached to said barrel clamping means and said stock clamping means for securing each of said clamping means in a clamped configuration when said firearm is mounted on said stand.

15. A stand for supporting a pistol having a barrel and a grip, said stand comprising:
(a) barrel clamping means for holding the barrel of said pistol, said barrel clamping means including a first and a second jaw;
(b) grip clamping means for holding the grip of said pistol, said grip clamping means including a base member having a flat bottom surface for supporting said stand, a top surface having a cavity formed therein for receiving the grip, a retaining member, and means for releasably securing the retaining member to the base member to clamp the grip of the pistol into the cavity of the base member;
(c) rod means for connecting the grip clamping means to the barrel clamping means, said rod means defining an axis about which the first and second jaws of the barrel clamping means pivot; and
(d) connector means for securing the barrel clamping means and the grip clamping means on said rod to vary the distance between the barrel clamping means and the grip clamping means to accommodate pistols of varying lengths.

16. The stand of claim 15, wherein each of said first and second jaws comprises:
(a) a generally triangular front surface;
(b) a generally triangular rear surface opposite said front surface;
(c) a bottom surface for supporting said jaw members in an upright position;
(d) an inner surface extending between said front and rear surfaces for contacting the barrel of said pistol when said jaws are in a closed position; and
(e) an outer surface opposed to said inner surface.

17. The stand of claim 16, wherein said barrel clamping means comprises:
(a) a pair of aligned notches formed in the inner surface of said first and second jaws for receiving the barrel of said pistol;
(b) a pair of parallel, spaced apart walls formed on the inner surface of said first and second jaws for use instead of said aligned notches to receive the housing of said pistol if said pistol is a semi-automatic pistol having a housing with parallel sides.

* * * * *